US008558744B2

(12) United States Patent
Tezuka et al.

(10) Patent No.: US 8,558,744 B2
(45) Date of Patent: Oct. 15, 2013

(54) ANTENNA DEVICE

(75) Inventors: Naotoshi Tezuka, Tokyo (JP); Ryoichi Shimizu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 387 days.

(21) Appl. No.: 12/992,680

(22) PCT Filed: May 13, 2009

(86) PCT No.: PCT/JP2009/058912
§ 371 (c)(1),
(2), (4) Date: Nov. 15, 2010

(87) PCT Pub. No.: WO2009/139410
PCT Pub. Date: Nov. 19, 2009

(65) Prior Publication Data

US 2011/0068986 A1 Mar. 24, 2011

(30) Foreign Application Priority Data

May 15, 2008 (JP) ..... 2008-128390

(51) Int. Cl.
*H01Q 1/32* (2006.01)

(52) U.S. Cl.
USPC ..... 343/711; 343/713

(58) Field of Classification Search
USPC ..... 343/713, 711, 705, 708
See application file for complete search history.

(56) References Cited

U.S. PATENT DOCUMENTS 6,031,499 A * 2/2000 Dichter ..... 343/713
6,542,121 B1 * 4/2003 Beale et al. ..... 342/442

FOREIGN PATENT DOCUMENTS

| | | | |
|---|---|---|---|
| JP | 48 031859 | | 4/1973 |
| JP | 2186807 | * | 7/1990 |
| JP | 06 334436 | | 12/1994 |
| JP | 11 127018 | | 5/1999 |
| JP | 2006 056280 | | 3/2006 |
| JP | 2007 218705 | | 8/2007 |

OTHER PUBLICATIONS

International Search Report issued Aug. 18, 2009 in PCT/JP09/058912 filed May 13, 2009.

* cited by examiner

*Primary Examiner* — Hoang V Nguyen
(74) *Attorney, Agent, or Firm* — Oblon, Spivak, McClelland, Maier & Neustadt, L.L.P.

(57) ABSTRACT

A mechanism of an antenna for positioning, which is mounted on a measuring vehicle to measure locations of geographic features on and the side of roads and to collect road map information, and which is capable of highly-reliable measurement even when the vehicle is travelling, is realized. The antenna for positioning according to the present invention includes a positioning antenna to receive radio waves from a positioning satellite, a column, to the upper end of which the antenna is attached, and a cylindrical plate to cover the longitudinal direction of the column, wherein by use of the plate, a problem with the strength of the column to hold the positioning antenna is solved by reducing a lift force acting on the positioning antenna while the vehicle is travelling, and further, wind noise is reduced, and a cable is prevented from being damaged.

10 Claims, 7 Drawing Sheets

ANTENNA DEVICE

TECHNICAL FIELD

The present invention relates to an antenna device that is mounted on a vehicle and that receives radio waves from a positioning satellite.

BACKGROUND ART

In recent years, products that combine the GIS (Geographical Information System) and the GPS (Global Positioning System), as represented by the car navigation system, have become significantly widespread. At the same time, application of location information by the GIS and the GPS to safe driving by the ITS (Intelligent Transport Systems) is expected, and location information of planimetric features on and the sides of roads is assumed to be efficient information. Meanwhile, greater precision and sophistication of a road inventory that records information of planimetric features around roads is desired. However, since it is necessary to make a high-precision survey to draft the road inventory that records locations of the planimetric features on or the sides of roads, such as distance marks, traffic signs, guardrails, white lines, etc. on a one five-hundredth scale, static measurement using the GPS and a total station to measure distances and angles is performed. Additionally, there may exist about two thousand features as measurement subjects in intervals of 30 km in round trip in national roads. As a result, enormous cost and time is required for greater precision and sophistication of the road inventory in all parts of countries.

Therefore, in the aim of reducing time and cost to collect information, attention is focused on a MMS (Mobile Mapping System), and research and development is performed on the MMS.

The MMS is a system wherein a measurement vehicle (called vehicle below) equipped with devices such as an odometry device, a gyroscope, a GPS antenna connected to a GPS receiver, a laser radar, and a camera, etc. runs roads to obtain locations of planimetric features, etc. around the roads and map information from the running vehicle. The odometry device calculates distance data indicating a travel distance of the vehicle by carrying out the odometry method.

As to the gyroscope, angular velocity data indicating the inclination of the vehicle in three-axial directions (pitch, roll, yaw angles) is calculated by mounting three gyroscopes, for example.

The GPS calculates positioning data indicating a running position (coordinate) of the vehicle.

The camera takes pictures or videos and outputs time-series image data.

The laser radar calculates direction and distance data indicating distances to a road surface in each direction.

The measuring unit of the MMS calculates a location of a feature designated by a user based on these distance data, angular velocity data, positioning data, image data, direction and distance data, etc.

The gyroscope, the GPS antenna, the laser radar, and the camera are all mounted on a top board of the vehicle and obtain various types of data. The top board is a frame made up of plural pillar-shaped members, and due to limited size of the top board of the vehicle, these devices are placed near to one another. However, when devices large in size like the camera and the laser radar are installed near the GPS antenna, the GPS antenna is placed behind these devices, so that the reception range is limited, which results in unstable reception of radio waves from a GPS satellite. For example, it may happen that by the vehicle turning an intersection, a radio wave which has been received to date is blocked by camera equipment and cannot be received.

As a countermeasure for this, it is considered a method to install the GPS antenna at higher position by using a supporting column, etc. so that a reception plane of the antenna is placed above the level of the other devices (see Patent literature 1, for example).

Patent literature 1: Japanese Unexamined Patent Publication No. 2007-218705

SUMMARY OF THE INVENTION

Problems to be Solved by the Invention

However, there are problems as follows when a GPS antenna is placed at higher position by using the supporting column in a case of mounting the GPS antenna on the top board of the vehicle:

(1) Blowing up from an upper stream acts on a disk surface of the GPS antenna, and intensity problem of the column for the GPS antenna occurs;

(2) Wind noise caused by an eddy formed by the newly installed column of the GPS antenna occurs when a vehicle is running. Especially when the vehicle is travelling fast, the wind noise becomes significant, and gets annoying noise;

(3) The column and a cable running out of the GPS antenna are damaged by hitting roadside trees, etc.

Furthermore, in addition to this, by placing the GPS antenna at higher position than the top board, radio waves penetrate also from the back side of the GPS antenna, and influence of so-called multipath may occur.

It is one of the main objects of the present invention to solve the above-mentioned problems, and it is a further object of the present invention to keep a column for a GPS antenna stable also when a vehicle is running by placing a cylindrical plate around the column, and to realize a mechanism possible of highly reliable measurement.

Means to Solve the Problems

There is provided according to one aspect of the present invention an antenna device including: an antenna, which is mounted on a vehicle, to receive a radio wave from a positioning satellite; and a column, to an upper end of which the antenna is attached; and a plate to cover a surrounding part of the column.

The plate is a hollow tubular plate to form a gap with the column.

The plate is in a cylindrical shape.

The plate is made of a metal.

An output cable of the positioning antenna is placed in the gap.

A joint column is provided in a shaft rotation direction of a longitudinal direction of the column, and an internal wall of the plate is connected to the column via the joint column.

The vehicle is a carriage for measurement that includes a shooting means to take a picture or a video of a surrounding area of the vehicle and a gyroscope to output angular velocity data that indicates an inclination of the vehicle, which are placed near the antenna in an upper section of the vehicle, and the column has a length so that the positioning antenna that is attached to an upper end of the column is placed at a position higher than a height of an upper surface of at least the shooting means or the gyroscope.

Effect of the Invention

According to the present invention, even in a case where the GPS antenna is placed above the top board of the vehicle by using the supporting column, the column is kept stable and highly reliable road information can be obtained.

PREFERRED EMBODIMENTS FOR CARRYING OUT THE INVENTION

Embodiment 1

Hereinafter, the first embodiment according to the present invention will be described with reference to FIG. 1 through FIG. 4.

Figure 1:
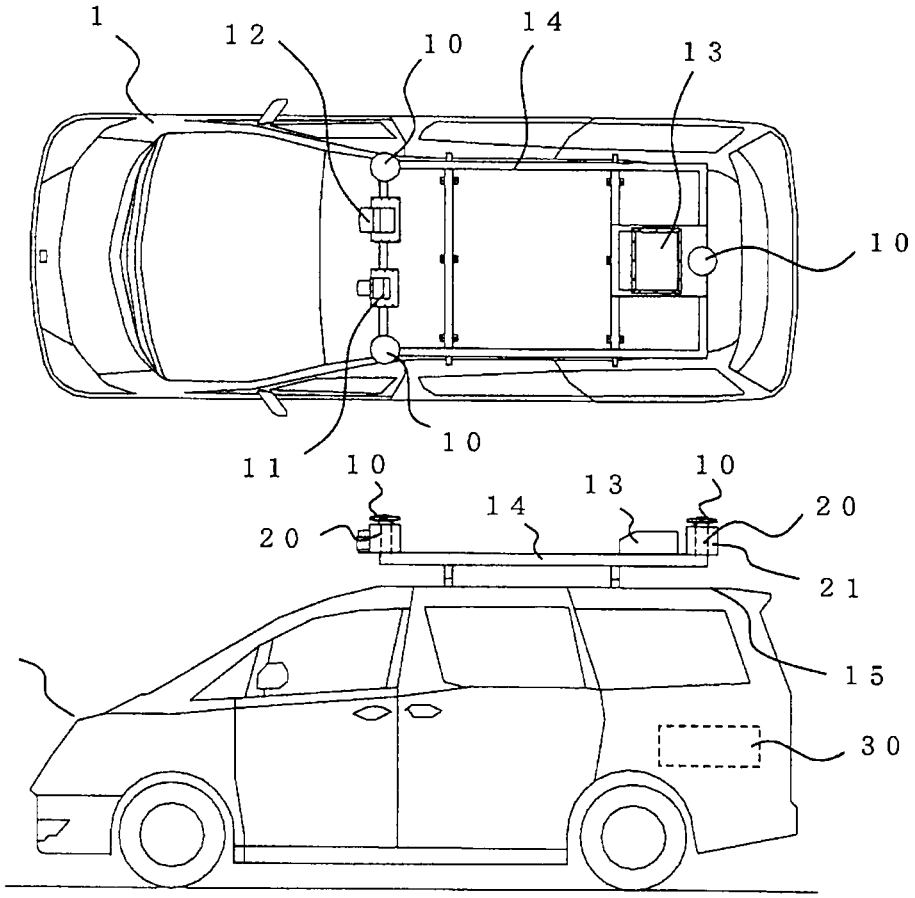
[FIG. 1] A diagram illustrating a vehicle whereon a GPS antenna according to the first embodiment is mounted.

FIG. 1 indicates an example of a vehicle whereon the GPS antenna according to the first embodiment is mounted.

FIG. 1A is a top view of the vehicle, and FIG. 1B is a side view of the vehicle. In the first embodiment, the vehicle is described as an example of movable bodies. The GPS antenna is one example of an antenna to receive positioning signals, which may be an antenna that is used in the Galileo or the GLONASS, etc. as positioning system other than the GPS.

A top board 14 as mounting base is attached to a top surface 15 of the body of the vehicle 1, whereon several devices can be mounted.

A visible camera 11 as shooting device is attached to the top board 14. The visible camera 11 takes a picture or video of the area ahead of the vehicle 1 and outputs time-series image data, for example.

A gyroscope 13 is attached to the top board 14. Three gyroscopes are housed in the gyroscope 13, which obtain angular velocity data indicating the inclination of the vehicle in three-axial directions (pitch, roll, yaw angles).

Additionally, a laser radar 12 (also called LRF [Laser Range Finder]) is attached to the top board 14. The laser radar 12 is placed in the front edge or the rear edge of the car body, and the laser radar 12 emits a laser in an obliquely downward direction by waving an optical axis in a transverse direction, and calculates direction and distance data (LRF data) indicating distances toward road surfaces in each direction.

A GPS antenna 10 is attached to the top board 14. The GPS antenna 10 receives radio waves from a GPS satellite moving in the sky, and a GPS receiver (not shown in diagrams) calculates positioning data which indicates a running position (coordinate) of the vehicle from the received radio waves.

The GPS antenna 10 in the present embodiment is fixed to a top of the column 20 and placed on the top board 14. The top board 14 is a frame made up of plural pillar-shaped members, and due to this, the diameter of the column 20 is limited depending on the width of the column members. That is, when the diameter of the column 20 is too large, the column 20 cannot be fixed to the top board stably, so that the column 20 with a diameter approximately the size of the width of the column members is selected.

As shown above, by attaching the GPS antenna 10 to the top of the column 20, the GPS antenna 10 can be placed at a higher position than the other devices (the visible camera 11, the gyroscope 13, and the laser radar 12) attached to the top board 14. Additionally, the column 20 has a structure wherein the periphery of the column 20 is covered by a cylindrical plate 21. The column 20 supporting the GPS antenna 10 and the plate 21 covering the periphery of the column 20 will be precisely described later. Here, in FIG. 1, it is described an example wherein three GPS antennas are mounted on the top board 14 and each GPS antenna receives radio waves from a GPS satellite; however, it is not limited to three antennas. The plate 21 can be formed in a shape covering the surrounding part of the column 20 by processing a planar plate member.

The vehicle 1 is equipped with a measurement device (calculator) 30, and the measurement device 20 obtains road information based on image data, angular velocity data, LRF data, and positioning data, etc. from the visible camera 11, the gyroscope 13, the laser radar 12, and the GPS antenna 10, which are mounted on the top board 14.

Figure 2:
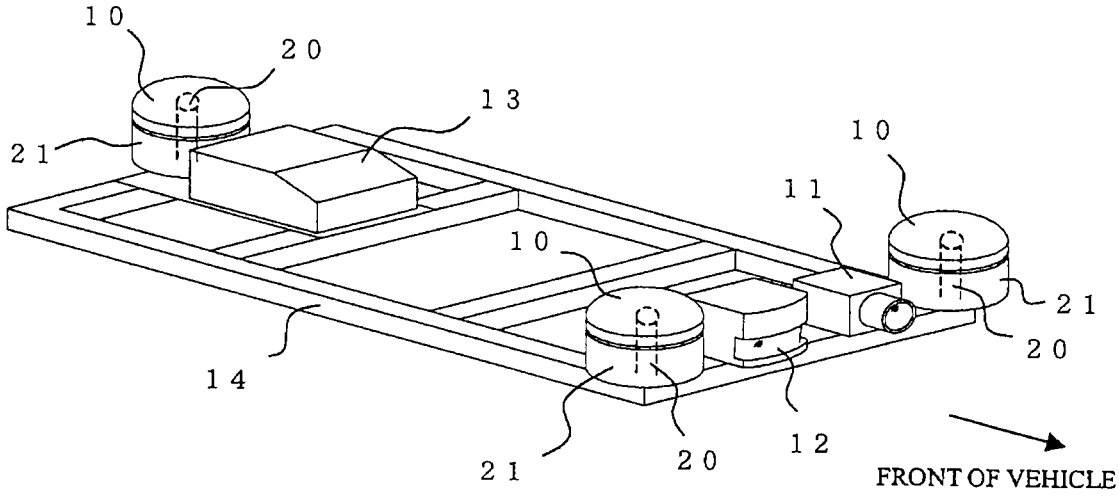
[FIG. 2] A perspective view of a top board whereon the GPS antenna according to the first embodiment is mounted.

FIG. 2 is a mounting example (perspective view) of mounting the visible camera 11, the gyroscope 13, the laser radar 12 and the GPS antenna 10 on the top board 14. The top board 14 is in the shape of a frame (casing) for weight saving, and each device is placed on each frame. The GPS antenna 10 has a discoid shape, the center position of which is secured with the column 20. The visible camera 11 and the laser radar 12 are about some dozens centimeters high, for instance, and the column 20 has such a length that the installed position of the GPS antenna 10 is higher than the upper surfaces of the visible camera 11 and the laser radar 12. While three GPS antennas are installed in the example of FIG. 2, each column needs not be the same in length, and it is only necessary to set the length of each column so that the GPS antenna 10 can successfully receive radio waves from GPS satellites depending on the installation height of the devices placed around the columns.

Figure 3:
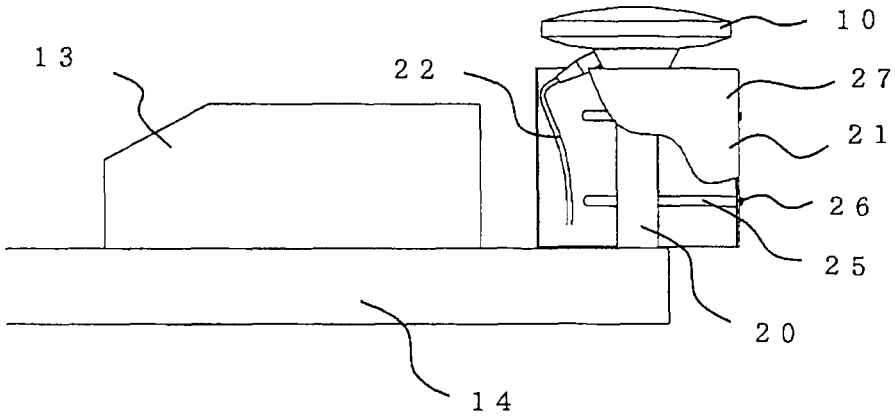
[FIG. 3] A side view of the surrounding part of the GPS antenna according to the first embodiment.
Figure 4:
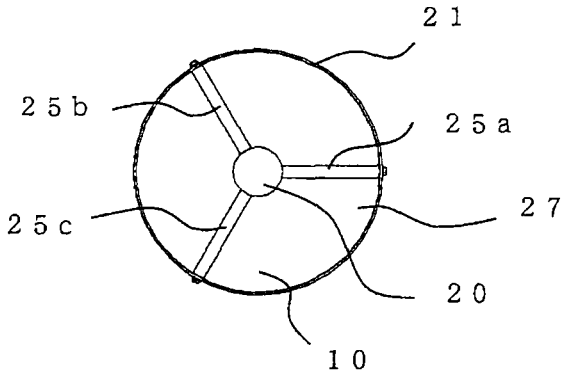
[FIG. 4] A top view of the GPS antenna according to the first embodiment.

FIG. 3 is a side view of the surrounding part of the GPS antenna 10 according to the first embodiment. FIG. 4 is the top view wherein the GPS antenna is viewed from above.

The GPS antenna 10 is attached to the upper end of the column 20. The GPS antenna 10 and the column 20 may be connected by screw fixation by stretching a connecting plate therebetween and fixing the connecting plate with screws, or may be connected and fixed by screwing the end of the column 20 which is in the form of a thread into a tapped hole formed in the lower surface of the GPS antenna 20. Meanwhile, the other end of the column 20 is fixed to the top board 14. The column 20 is made of a metal, or made by resin molding, for example.

The column 20 includes a joint column 25 in a direction perpendicular to the longer direction of the column 20. The joint column 25 is made of a metal or a resin, etc. Three joint columns 25 are arranged at angular intervals of about 120 degrees from one another in the rotational direction around the column 20, in two layers in the vertical direction.

The plate 21 is a cylindrical plate, and the ends of the joint columns 25 are connected and secured to the cylindrical metallic plate in its internal side. Holes are formed in the plate 21 at the positions of the ends of the joint columns 25, and the plate 21 and the joint columns 25 are integrally fixated with screws 26. In this way, the column 20 and the plate 21 are integrally secured with the joint columns 25, and the plate 21 is placed around the column 20 in a manner to cover the longer direction of the column 20.

In this way, the plate 21 covers the surrounding part of the column 20, and a space 27 whereof the upper end and the lower end are left open is formed between the column 20 and the plate 21.

The width of the plate 21 in the longer direction that covers the column 20 is set so that the plate 21 does not prevent the GPS antenna 20 from receiving radio waves from a positioning satellite (GPS satellite that transmits positioning signals by the GPS, etc. or so on). Further, the plate 21 may contact with the top board 14, or a gap may exist between the plate 21 and the top board 14 so as to avoid a vibration or an impact from the top board 14. Further, the number of the joint columns 25 may be changed within a range where intensity does not matter.

An output cable 22 of the GPS antenna 10 is made to run through the space 27 formed between the plate 21 and the column 20, and pulled into the measurement device. In this way, it is possible to prevent the output cable 22 from being exposed to the exterior.

The plate 21 is made of a metal or a resin, etc., and the plate 21 may be made of a metallic plate, or a resin plate whereof the periphery is coated with metal in order to actively avoid influence of multipath as mentioned below.

A comparison with a conventional GPS antenna that is installed on the top board 14 on the vehicle 1 will be presented here.

Figure 7:
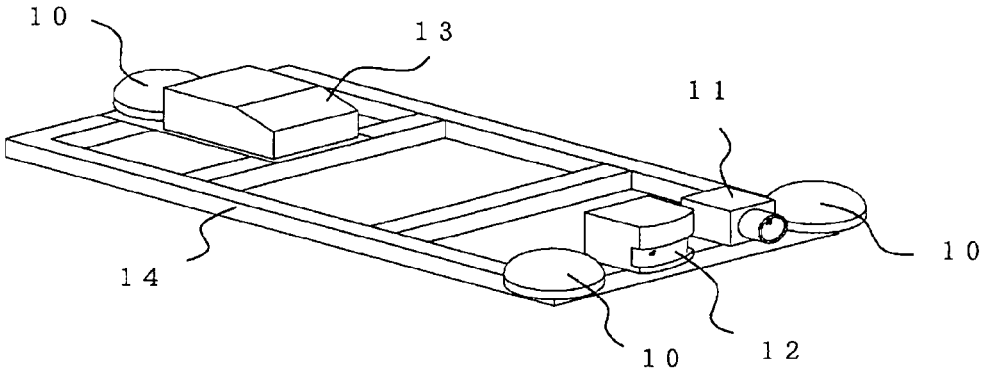
[FIG. 7] One example of a perspective view of a top board whereon a conventional GPS antenna is mounted.

FIG. 7 is a conventional example of device installation when the GPS antenna 10 is installed on the top board 14 directly without using the column 20.

In the example of installing the GPS antenna 10 on the top board 14 directly as shown in FIG. 7, the camera 11, the laser radar 12 and the gyroscope 13 placed near the GPS antenna 10 block radio waves, and the GPS antenna cannot receive radio waves from GPS satellites stably.

Figure 8:
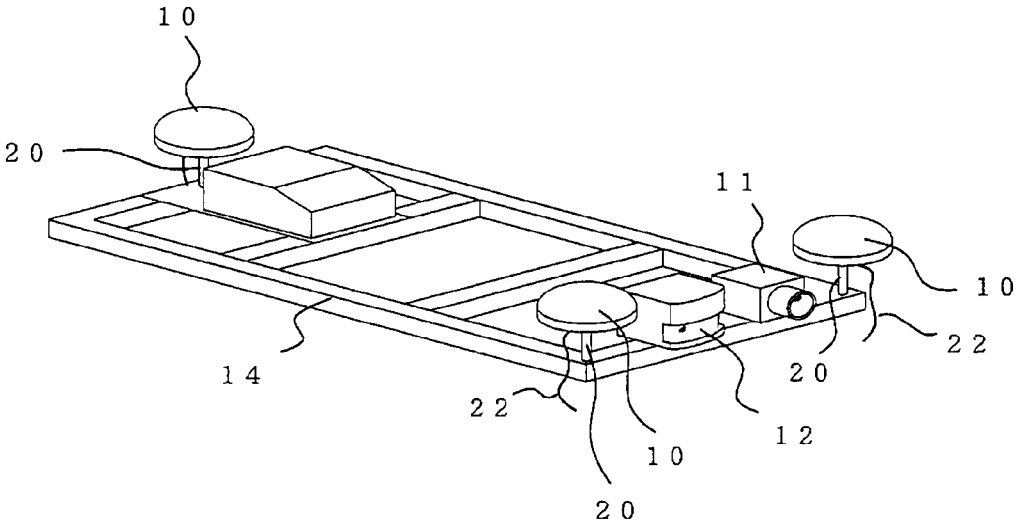
[FIG. 8] One example of a perspective view of a top board whereon a conventional GPS antenna is mounted.

FIG. 8 is a conventional example of device installation when the GPS antenna 10 is installed at a higher position than the upper surfaces of surrounding devices by using the column 20.

In the conventional example as shown in FIG. 8, reception condition of the GPS antenna 10 becomes stable; however, another problem occurs.

That is, by using the column 20, wind noise occurs when the vehicle cruises at high speed, caused by formation of an eddy by the antenna or the thin column of the antenna, separation or disappearance in a wake flow, or an accelerated movement. Additionally, pressure fluctuation is caused by a separation eddy generated by the other mounted objects on an upper stream (windward side) of the vehicle body or the GPS antenna 10 hitting the GPS antenna 10, to result into wind noise which becomes annoying noise.

Further, a lift force acts on the disk surface of the GPS antenna by a blowing up from an upper stream (windward side), and there is a possibility that intensity problem of the column 20 occurs.

Figure 9:
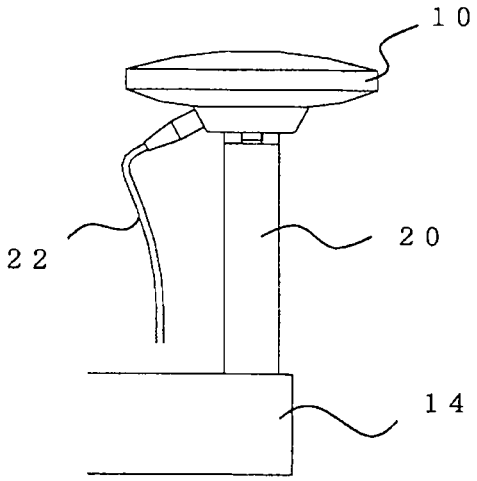
[FIG. 9] A side view of the surrounding part of a conventional GPS antenna.

In addition, there is a possibility that the output cable 22 running out of the GPS antenna 20 (see FIG. 9) is damaged by hitting roadside trees while the vehicle is traveling.

In contrast, the GPS antenna of the present embodiment as shown in FIG. 1 through FIG. 4 has a structure that the surrounding part of the column 20 is covered by the cylindrical plate 21.

By making the front surface of the GPS antenna 10 in a bluff shape as seen above, it is possible to reduce abrupt change of an eddy generated while a vehicle is running, formation of a separation area located posterior to the plate 21, and generation of wind noise.

At the same time, it is possible to reduce a lift force acting on the disk of the GPS antenna 10.

On the other hand, when the GPS antenna 10 is installed at a higher position than the upper surfaces of the devices surrounding the GPS antenna 10 by using the column 20 as shown in FIG. 8, it becomes more likely to be affected by so-called multipath.

Generally, in designing an antenna, designs that reduce the influence of multipath are adopted. However, even in such a case, the antenna is sensitive to radio waves entering from the rear side of the antenna.

When the GPS antenna 10 is installed at a position higher than the top board 14 by using the column 20 as shown in FIG. 8, the GPS antenna 10 receives radio waves reflected by the top board 14, a hood of the vehicle 1 or an upper surface of a cabin, and becomes likely to be affected by multipath.

As a method to reduce multipath, a measure to attach a ground plane to the GPS antenna, and a measure to attach a choke ring designed in consideration of characteristics of RF signals to the GPS antenna can be considered.

If the GPS antenna is used in a static condition, these measures for attaching the ground plane or the choke ring are effective as countermeasures for multipath.

However, the GPS antenna of the present invention is supposed to be mounted on a vehicle, and it is difficult to apply these measures, i.e., the ground plane or the choke ring, to the GPS antenna installed at the end of the column 20 on the top board 14 as shown in FIG. 8, since a large aerodynamic force is generated while the vehicle is moving.

On the other hand, the GPS antenna of the present embodiment as shown in FIG. 1 through FIG. 4 has the structure that the surrounding part of the column 20 is covered by the cylindrical plate 21. The cylindrical plate 21 of the present embodiment can block radio waves reflected by the top board 14, the hood of the vehicle 1 or the upper surface of the cabin, and reduce radio waves entering from the rear side of the antenna into the GPS antenna 10.

In this case, it is possible to increase blocking effect of radio waves by having the plate 21 made of a metal, or made of a resin whereof the periphery is coated with metal.

Further, since the ground plane or the choke ring is not added to the GPS antenna of the present embodiment, a large aerodynamic force is not generated while the vehicle is running.

As mentioned above, according to the GPS antenna mounted on the vehicle of the present embodiment, the GPS antenna is installed at the end of the column, the installation height of the GPS antenna is set so that the GPS antenna can receive radio waves from satellites stably without being affected by the devices mounted in the surrounding area, and further, the metallic plate in a cylindrical form is formed around the column to cover the column.

In this way, it is possible to reduce (1) a lift force acting on the disk surface of the GPS antenna, (2) wind noise while the vehicle is moving, (3) damage on the output cable of the GPS antenna, and to obtain highly reliable road information while the vehicle is moving as well. Furthermore, it is possible to have it function effectively also as a countermeasure for multipath.

Furthermore, travelling performance of the vehicle is also improved, and it is possible to reduce energy consumption while the vehicle is running.

Embodiment 2

While the plate 21 covering the column 20 is cylindrical-shaped in the first embodiment, in the second embodiment, it is triangle-shaped whereof the front side in the direction of forward movement of the vehicle is acute-angled.

Figure 5:
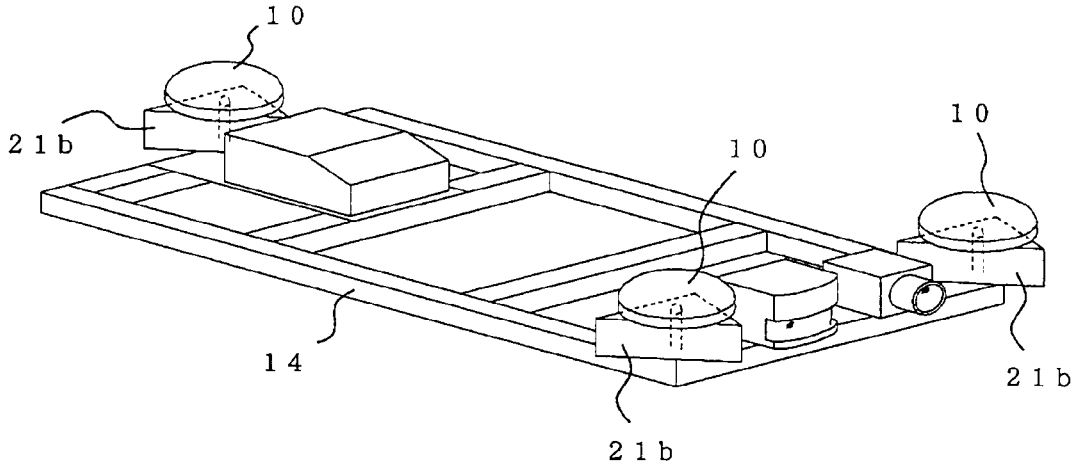
[FIG. 5] A perspective view of the GPS antenna according to the second embodiment.

FIG. 5 is an installation example (perspective view) of installing a plate 21*b* of the present embodiment on the top board 14 in a manner to cover the GPS antenna 10. As just described, it is also acceptable to place a triangle-shaped plate whereof the front side in the direction of forward movement of the vehicle is acute-angled, in consideration of reduction of aerodynamic load.

Further, it is possible to improve travelling performance of the vehicle as well, and to improve energy conservation.

Embodiment 3

Figure 6:
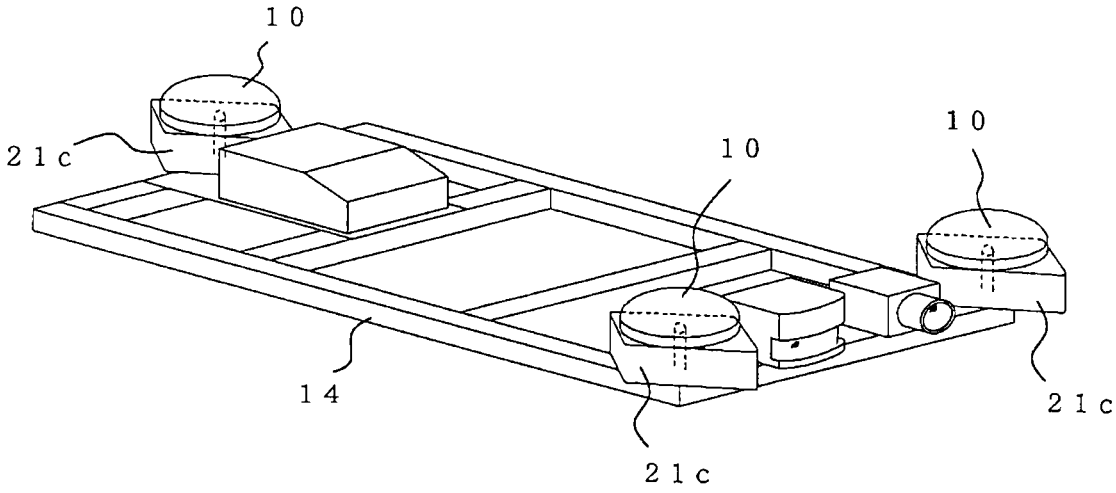
[FIG. 6] A perspective view of the GPS antenna according to the third embodiment.

While the plate 21 is a triangle-shaped plate in the second embodiment, it may be in a rectangular shape. FIG. 6 is an installation example (perspective view) of installing a plate 21*c* of the present embodiment on the top board 14 in a manner to cover the GPS antenna 10. As just described, it is also acceptable to place a rectangular-shaped plate whereof the front side in the direction of forward movement of the vehicle is acute-angled, and in this way, wiring protection, etc. is performed and aerodynamic load is reduced so that it is possible to protect the GPS antenna and reduce wind noise.

Further, it is possible to improve travelling performance of the vehicle as well, and improve energy conservation.

Description of the Reference Numerals

1 Vehicle; 10 GPS antenna; 11 Camera; 12 Laser radar; 13 Gyroscope; 14 Top board; 15 Upper surface of the vehicle; 20 Column; 21, 21*b*, 21*c* Plate; 22 Output cable; 25*a*, 25*b*, 25*c* Joint column; 26 Screw; 27 Space formed between the column and the plate.

The invention claimed is:

1. An antenna device comprising:

an antenna, which is mounted on a vehicle, to receive a radio wave from a positioning satellite; and a column, to an upper end of which the antenna is attached; and a plate to cover a surrounding part of the column, wherein the plate is a hollow tubular plate to form a gap with the column, and wherein an output cable of the antenna is placed in the gap.

2. The antenna device as defined in claim 1, wherein the plate is in a cylindrical shape.

3. The antenna device as defined in claim 1, wherein the plate is made of a metal.

4. The antenna device as defined in claim 1, wherein a joint column is provided in a shaft rotation direction of a longitudinal direction of the column, and an internal wall of the plate is connected to the column via the joint column.

5. The antenna device as defined in claim 1, wherein the vehicle is a carriage for measurement that includes a shooting device to take a picture or a video of a surrounding area of the vehicle and a gyroscope to output angular velocity data that indicates an inclination of the vehicle, which are placed near the antenna in an upper section of the vehicle, and the column has a length so that the antenna that is attached to an upper end of the column is placed at a position higher than a height of an upper surface of at least the shooting device or the gyroscope.

6. A vehicle comprising the antenna device as defined in claim 1.

7. A vehicle comprising: on a front side two mounted antenna devices as defined in claim 1, and on a back side one mounted antenna device as defined in claim 1.

8. An antenna device comprising:

an antenna, which is mounted on a vehicle, to receive a radio wave from a positioning satellite; and a column, to an upper end of which the antenna is attached; and a plate to cover a surrounding part of the column, wherein a joint column is provided in a shaft rotation direction of a longitudinal direction of the column, and an internal wall of the plate is connected to the column via the joint column.

9. An antenna device comprising:

an antenna, which is mounted on a vehicle, to receive a radio wave from a positioning satellite; and a column, to an upper end of which the antenna is attached; and a plate to cover a surrounding part of the column, wherein the vehicle is a carriage for measurement that includes a shooting device to take a picture or a video of a surrounding area of the vehicle and a gyroscope to output angular velocity data that indicates an inclination of the vehicle, which are placed near the antenna in an upper section of the vehicle, and the column has a length so that the antenna that is attached to an upper end of the column is placed at a position higher than a height of an upper surface of at least the shooting device or the gyroscope.

10. A vehicle comprising:

two antenna devices mounted on a front side; and one antenna device mounted on a back side, wherein each of the antenna devices includes an antenna to receive a radio wave from a positioning satellite, a column, to an upper end of which the antenna is attached, and a plate to cover a surrounding part of the column.

* * * * *